US006050115A

United States Patent [19]

Schröter et al.

[11] Patent Number: 6,050,115

[45] Date of Patent: Apr. 18, 2000

[54] LOCKING DEVICE

[75] Inventors: Frank Schröter, Münster; Ludger Kaup; Alfred Dinkelborg, both of Everswinkel, all of Germany

[73] Assignee: Aug. Winkhaus GmbH. Co., KG, Telgte, Germany

[21] Appl. No.: 08/821,583

[22] Filed: Mar. 18, 1997

[30] Foreign Application Priority Data

Mar. 18, 1996 [DE] Germany ..... 196 10 346

[51] Int. Cl.[7] ..... E05B 59/00

[52] U.S. Cl. ..... 70/107; 70/108; 292/37; 292/39; 292/268; 292/51

[58] Field of Search ..... 70/107, 108, 110, 70/111, 113, 118, 120, 130, 134, 144, 150; 292/34–39, 262, 268

[56] References Cited

U.S. PATENT DOCUMENTS

| | | | |
|---|---|---|---|
| 2,369,136 | 2/1945 | Chambers et al. | 292/268 |
| 2,622,429 | 12/1952 | Lipiner | 292/268 X |
| 3,458,226 | 7/1969 | Carlston | 292/268 |
| 3,881,331 | 5/1975 | Tranberg et al. | 70/107 |
| 4,259,811 | 4/1981 | Davis | 292/268 X |
| 4,593,946 | 6/1986 | Rich | 292/262 X |
| 4,870,841 | 10/1989 | Cudd | 70/107 |
| 4,962,653 | 10/1990 | Kaup | 292/39 X |
| 5,048,880 | 9/1991 | Narazaki | 292/262 |
| 5,083,448 | 1/1992 | Karkkainen et al. | 70/107 X |
| 5,171,047 | 12/1992 | Korb et al. | 292/39 |
| 5,265,920 | 11/1993 | Kaup et al. | 70/110 X |
| 5,495,731 | 3/1996 | Riznik | 292/39 X |

*Primary Examiner*—Suzanne Dino Barrett
*Attorney, Agent, or Firm*—Pillsbury Madison & Sutro LLP

[57] ABSTRACT

A rod system device extending from its lock unit to a tensioning device of the door catch mechanism which takes up two positions is connected in the door catch mechanism with a pivotable unlocking hammer so that the door catch mechanism can be released from the drive rod locking mechanism. The door catch mechanism has an unlocking lever which, when engaged with a bolt element, is ready for contact opposite a trigger element of the tensioning device so that following the unlocking of a bar/drive rod locking unit with the lock unit, the bolt element can be moved from the engagement position to a release position by deflection of the unlocking hammer.

9 Claims, 7 Drawing Sheets

LOCKING DEVICE

FIELD OF THE INVENTION

The invention relates to a locking device for a door with a rigid frame.

BACKGROUND OF THE INVENTION

A locking device for a door with a rigid frame, which consists of a drive rod lock and a door catch mechanism, is known from German Patent Publication DE-C-3 503 466. The drive rod lock has a drive rod coupled with a bar actuating device. In this case the drive rod is used, on the one hand, for the mechanical coupling of the main lock with at least one additional lock. On the other hand it is used to push a bolt of the door catch mechanism from an engagement position to a released position. Displacement of the bolt into the engagement position takes place via a toothed wheel gear. A cone is disposed on the drive rod in the area of the bolt. The cone is guided along a pin connected with the bolt by the movement of the drive rod and is pushed into the release position by this. By this technique the bolt is released from a pivot shackle, which is connected with a rigid frame bordering the door.

It is disadvantageous that in the course of an unlocking movement for releasing the door that the entire drive rod must also be moved. Furthermore, an additional force must be applied pushing the bolt back. It is furthermore disadvantageous that it is necessary to perform uncoupling with respect to the additional locks because of the employment of the drive rod as door catch release element. If this uncoupling does not take place, it additionally makes the actuation of the locking device more difficult when opening the door.

Another drive rod lock is known from German Patent Publication DE-C-3 836 693 and has a center lock attached to a cuff plate. A drive rod-activated additional lock extends above it. A center lock catch and a blocking element of the additional lock can be synchronously displaced into an opening position by the follower of the center lock as well as by key actuation of the latter. A slide, which is controlled by the strike plate, has a catch ramp and is prestressed by a spring in an outward direction and is assigned to the blocking element of the additional lock for releasing the additional blocking element, which is captive in the retracted position and extends for actuation of the drive rod when it is released. The pre-stressed slide is intended to improve the security of the door without a key actuation after it has been pulled shut.

A further drive rod lock is known from German Patent Publications DE-A-3 831 529 and DE-A-4 114 007, wherein a bar/drive rod locking unit is operated by means of a handle follower. A bar and the drive rod with additional locks is operated by turning the handle follower. Blocking of the bar/drive rod locking unit takes place with the aid of a key, so that displacement out of its locking position into an open position is prevented.

Now, if a door in which such a drive rod lock is disposed is additionally provided with a door catch mechanism, a release position cannot be achieved with the aid of the drive rod, because opening of the door is performed by door handles on both sides of the door. Coupling such an opening process with a displacement of the bolt of the door catch mechanism into a released position would inevitably lead to the ineffectiveness of the door catch mechanism.

But uncoupling would result in that a door which can be unlatched would nevertheless remain locked, because in the engagement position the bolt does not release the pivot shackle of the door catch mechanism.

OBJECT AND SUMMARY OF THE INVENTION

It is, therefore, an object of the invention to further develop a known locking device for a door with a rigid frame in such a way that when a drive rod locking mechanism is employed, a door catch mechanism can be released by means of the drive rod locking mechanism.

This object is attained in accordance with the present invention.

The advantages obtained by the invention include, in particular, that after unblocking of the bar/drive rod locking unit with the locking unit, the door catch mechanism can be brought into an unblocking position by moving the locking unit further into an unblocking position. This unblocking is made easier in that the "wound up" bolt element is returned into its base position with the aid of an unlocking hammer. The forces to be exerted by the locking unit are reduced to only a slight triggering movement. Additional forces for pushing the bolt element back are not required.

By means of this it is possible for the tensioning device to consist of a pivotably arranged knob follower. The triggering element is disposed on the knob follower. An end bar hinge element is fastened in a rotatingly movable manner between the end of the knob follower, opposite the trigger element, and a pin disposed on the bolt element. Because of this it is possible for the tensioning unit in cooperation with the energy-charged bolt element, to take up two compulsory positions. The energy charge of the bolt element, preferably, is caused by a tension spring. The tension spring is tensioned in the course of the bolt element being pushed out into its engagement position, and this tensioned end position is maintained by means of the end position hinge element. If the knob follower is activated by means of the trigger element, the second end position is taken up by means of the end position element, and therefore a relaxation of the tension spring, together with a return of the bolt element into its release position.

It is advantageous if the rod device is composed of the following elements:

- a key plate, which can be displaced by a lock bit of the locking unit or a tumbler of the bar/drive rod locking unit,
- a latch plate, one end of which can be laid against the key plate, with the opposite end being connected with an adjustable movement transmission element, and
- a door catch plate which bridges the gap between the drive rod locking mechanism and the door catch mechanism, into one end of which the movement transmission element projects in a frictionally connected manner and into the other end the unlocking hammer projects in a frictionally connected manner.

The key plate and the latch plate are both disposed on the drive rod locking mechanism.

By means of this division of the rods it is achieved that the travel from the locking unit up to the unlocking hammer is guided in a position- and function-correct manner. It is furthermore assured that the unlocking hammer is not actuated when the bar/drive rod locking unit is locked, and that the locking process by means of the bar/drive rod locking mechanism is not interfered with.

In this case the key plate can be embodied with a profile designed in a U-shape that extends parallel with the bar. One leg of the U-shaped key plate can be in contact with the lock bit. The other leg of the key plate can rest against the latch plate.

A locking recess can be cut into the latch plate, in which a pin, fixed on the drive rod of the bar/drive rod locking mechanism, is adjustably arranged. By means of this it is assured that the door catch mechanism cannot be made ineffective when the door is locked with the aid of the bar/drive rod locking mechanism with the rods installed for unlocking.

The movement or transmission element can be embodied with a profile designed in an L-shape.

The resulting longer leg can be a lever rod element, which projects into a rod engagement recess.

The short leg of the L-shape can be a contact lever element, which is connected in a rotatingly movable manner with the other end of the latch plate.

A rotating lever bearing can be disposed in the connecting point between the rod lever element and the contact lever element.

It is advantageous if the unlocking hammer has a configuration which is similar to a normal hammer. Such an unlocking hammer can include a link stem, one end of which is frictionally connected with the door catch plate, and whose other end is seated with the hammer in a pivot pin. The hammer itself is composed of the unlocking lever and a stop lever disposed opposite the pivot pin.

An energy storage-guided rod system stroke limitation element, operated by a spring element, can be disposed on the latch plate, which has an engagement recess which can be positioned opposite the pin fixed in place on the drive rod. A directed movement limitation of the entire rod system is achieved by this and damage to the unlocking hammer is prevented.

An exemplary embodiment of the invention is represented in the drawings and will be described in detail below.

DETAILED DESCRIPTION OF THE PREFERRED EMBODIMENT

Figure 1A:
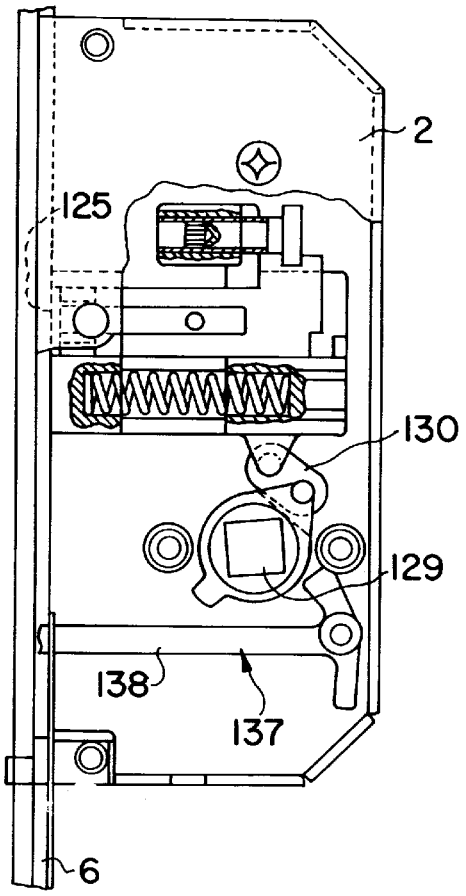
FIG. 1*a* is a side elevational view of a locking device with a drive rod locking mechanism.
Figure 1B:
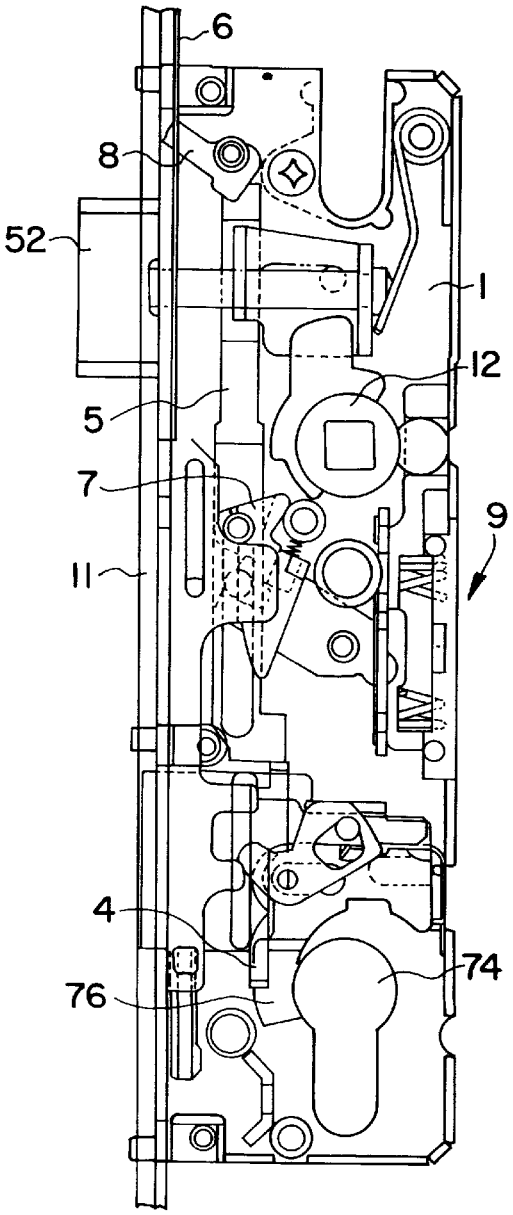
FIG. 1*b* is a side elevational view of a separately arranged door catch mechanism in an uninstalled, at least partially open state.

A locking device in accordance with FIGS. 1*a* and 1*b* includes a drive rod locking mechanism 1 (main lock), and a door catch mechanism 2 (door guard).

It is essential for the invention that a rod mechanism 4, 5, 6, 8 is guided by a locking unit 74, 76 as far as up to the door catch mechanism 2.

The rod mechanism is comprised of a key plate 4, a latch plate 5 and a movement transmission lever element 8.

Figures 3, 4, 5:
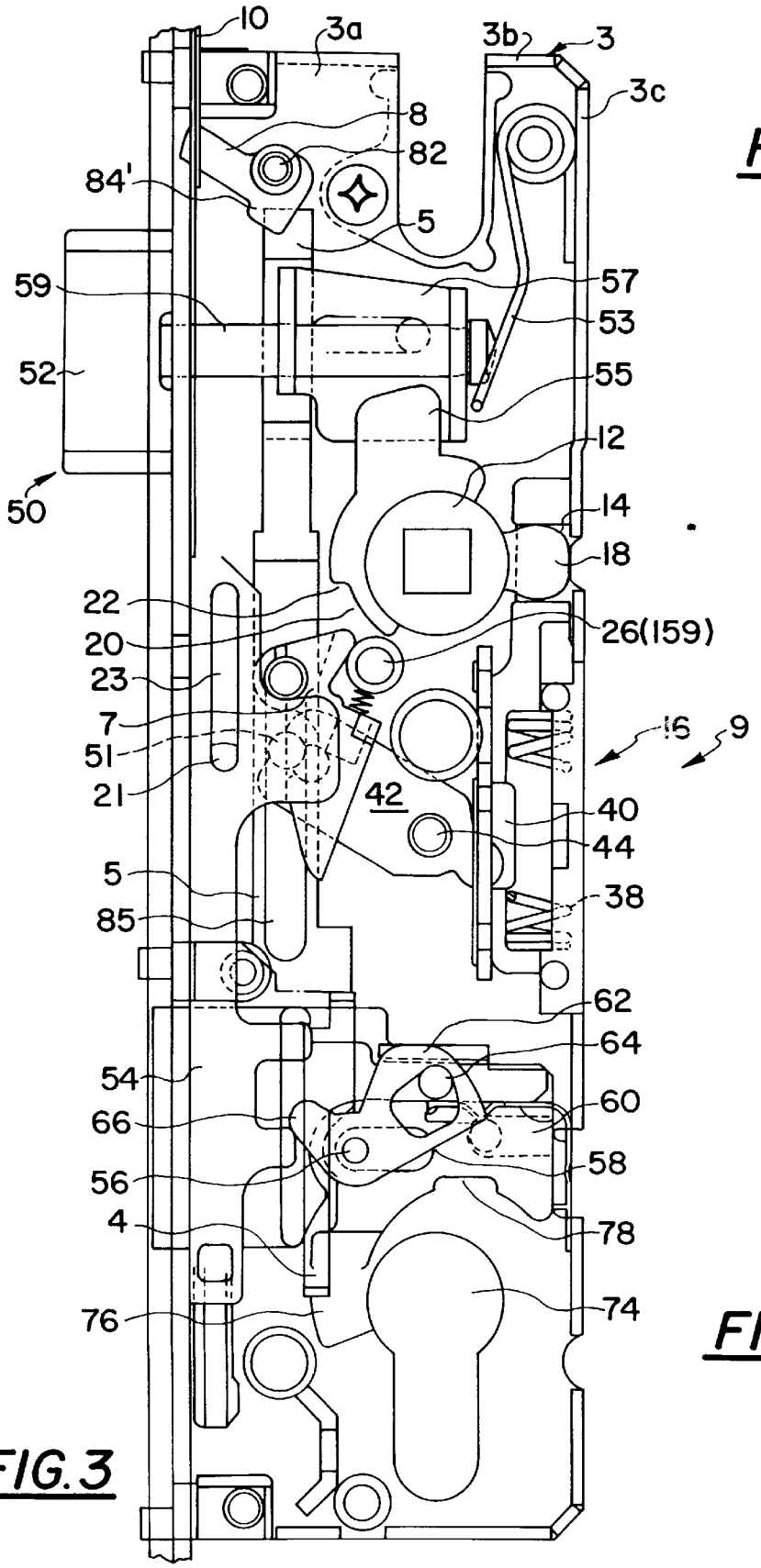
FIG. 3 is a side elevational view of a drive rod locking mechanism of a locking device in accordance with FIG. 1*b* on an enlarged scale.
FIG. 4 is schematic lateral view of a key plate of a locking device in accordance with the present invention.
FIG. 5 is schematic lateral view of a latch plate of a locking device in accordance with the present invention.

As shown in FIGS. 3 and 4, the key plate 4 is embodied to have a U-shaped cross section and has bent or shaped legs 47 and 48. Key plate 4 starts at the lock unit 74, 76. The lock unit comprises a lock cylinder 74 with a lock bit 76. The lower shaped leg 47 is positioned in such a way that it can be brought into contact with the lock bit 76. The key plate 4 is arranged in such a way that it can be displaced parallel with a bar 54.

The lower end of latch plate 5 contacts the shaped leg 48 of the key plate 4. It has a profile matched to the installation conditions of a drive rod locking mechanism (see FIGS. 3 and 5). The latch plate 5 has a locking recess 85 in the form of an elongated hole, in which a pin 51, fixed on the drive rod 10, is displaceably positioned. A rod system stroke limitation element 7 is disposed in the manner of a pivot hinge over the pin 51 fixed on the drive rod 10, as shown in particular in FIG. 7. The rod system stroke limitation element 7 has a duck-like shape. Its guide lug 157 contacts a pivot bearing 159. The pivot bearing 159 is connected via a guide spring 160 with the rod system stroke limitation lever element 7. The rod system stroke limitation element 7 has an engagement recess 161, which can be brought into engagement with the pin 51, fixed on the drive rod 10.

The movement transmission lever element 8 (see FIGS. 3 and 7) has a configuration similar to a dog's head. The muzzle represents a lever rod element 81, the head itself a contact lever element 84', and the eye a lever pivot bearing 82. The end of the contact lever element 84' rests frictionally connected against the latch plate 5.

Finally, the rod system mechanism composed of a door catch plate 6.

Figure 7:
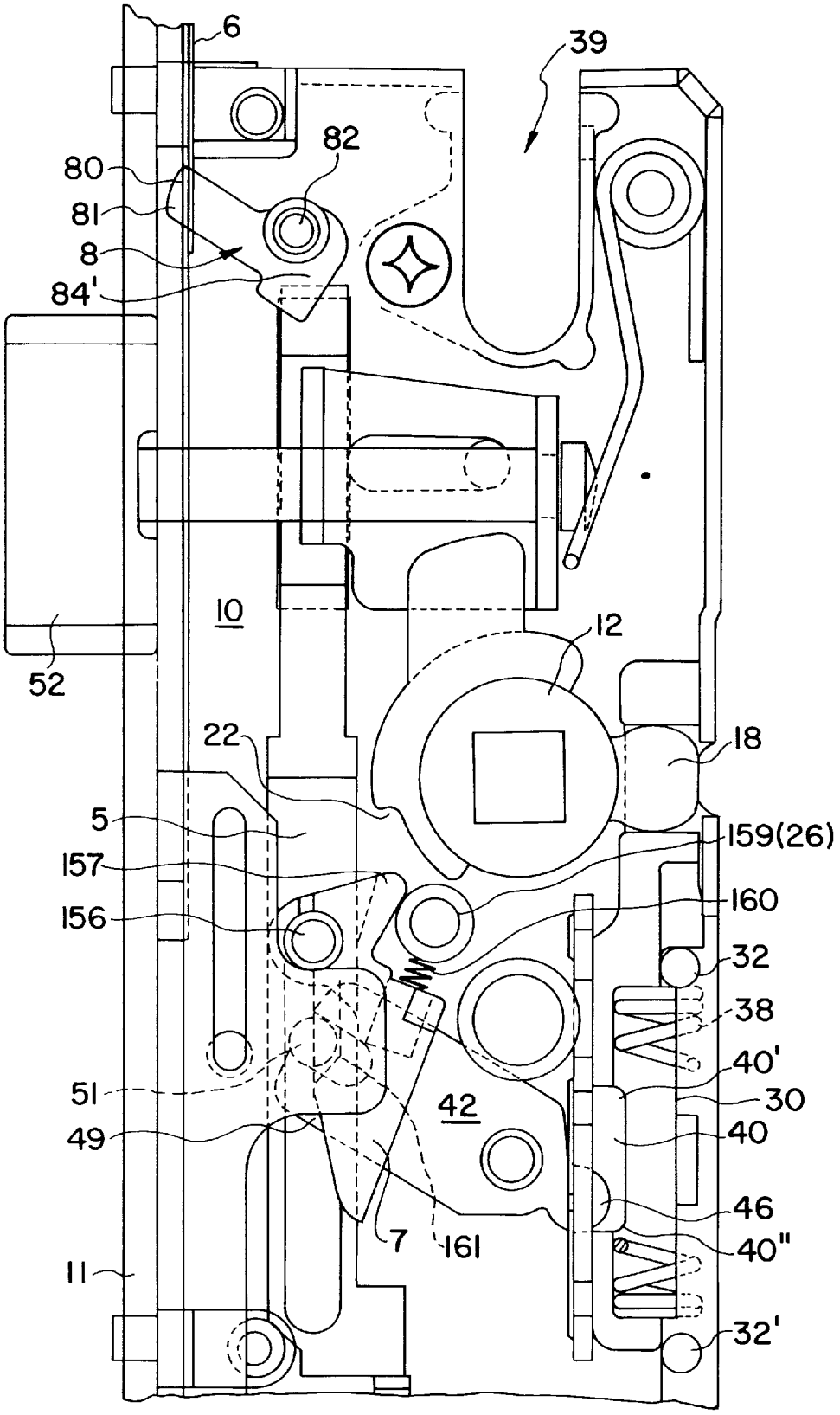

As shown in FIG. 7, the door catch plate 6 has a rod engagement recess 80, which is engaged in a frictionally connected manner by the lever rod element 81. The door catch plate 6 can be embodied as a rod, it can have a flat profile or it can be in the form of a cable or chain. The unlocking hammer 137, shown in FIG. 1*a*, acts with its link stem 138 on the end opposite the rod engagement recess 80. The link stem 138 leads to a pivot pin 139 and makes a transition into a hammer element consisting of an unlocking lever 140 and a stop lever 141 (see FIG. 8 in particular).

By means of the rod system mechanism embodied in this way it is possible to move the unlocking hammer 137 with the aid of the lock bit 76.

Figure 2:
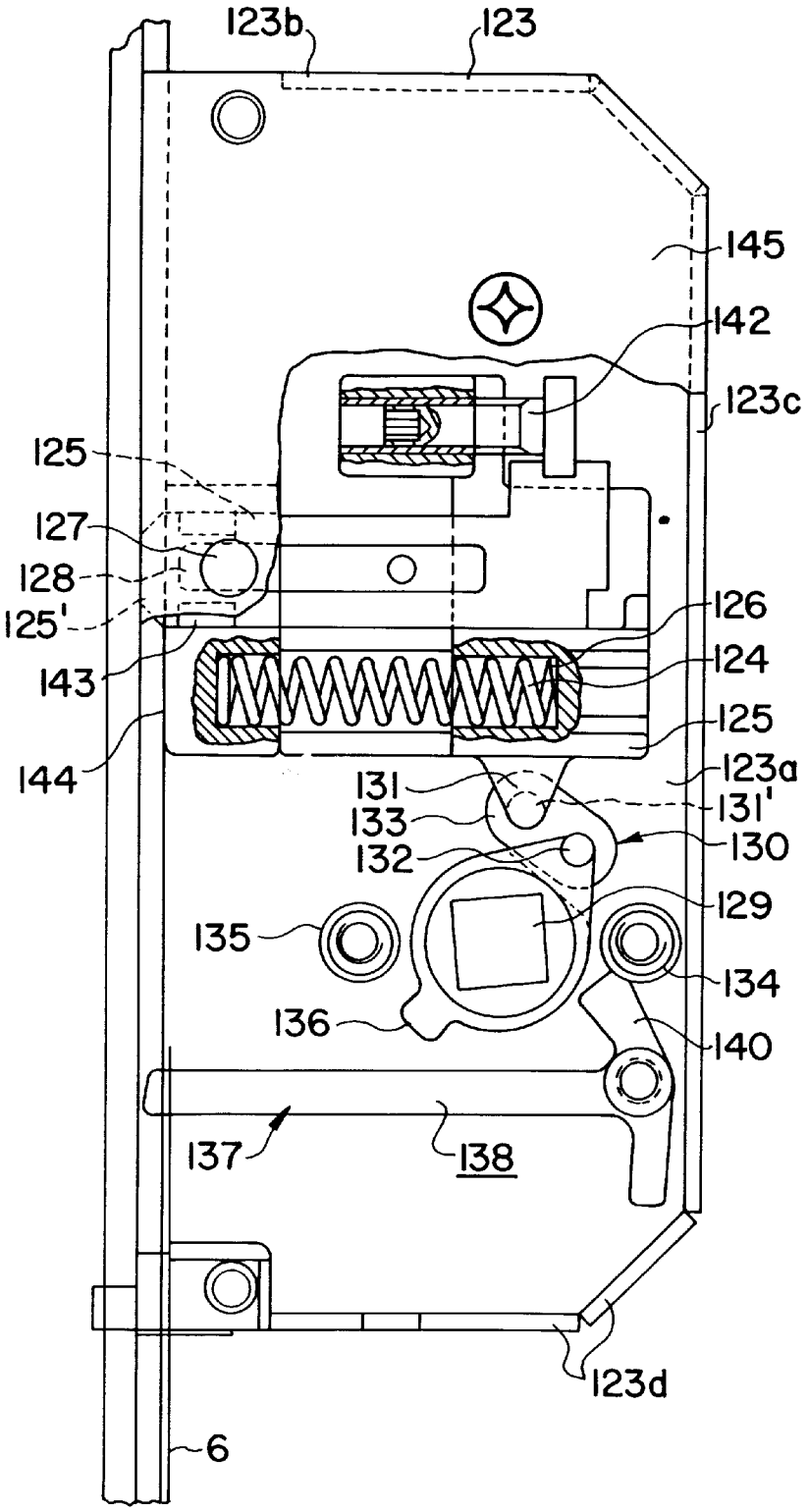
FIG. 2 is a side elevational view of a door catch mechanism of a locking device in accordance with FIG. 1*a* on an enlarged scale.
Figure 8:
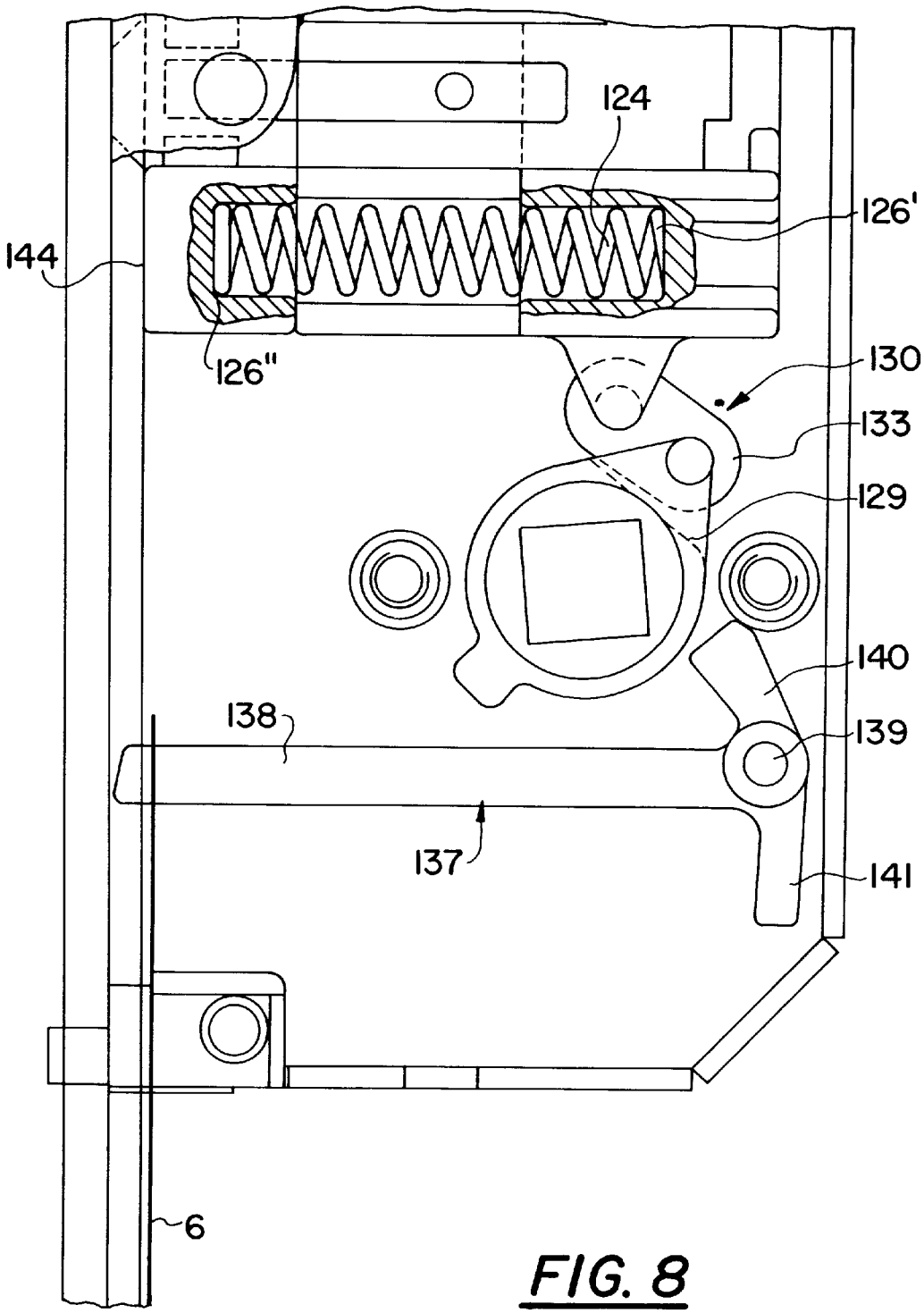
FIG. 8 is an enlarged partial representation of a door catch mechanism in accordance with FIG. 2.

As shown in FIGS. 2 and 8, the unlocking hammer is arranged in the door catch mechanism 2. The door catch mechanism 2 includes of a housing 123 with a floor plate 123*a*, which is surrounded by narrow side enclosing walls 123*b*, 123*c* and 123*d*. The housing is closed by a cover 145, which has been shown at least partially in FIG. 2.

An engagement bolt element 125, which can be tensioned and guided, is arranged in the housing 123. Guidance of the engagement bolt element 125 along a guide bolt 127 takes place by a guide recess 128 cut into it. The guidance is assisted by a bar guide 143. A spring reception recess 126 is disposed underneath the guide recess 128. The spring reception recess 126 is disposed partially in the engagement bolt element 125 and partially in a holding plate 144, on which the guide bolt 127 is also positioned. A gap is located in-between, which is bordered by guide rails. A tension spring 124 is positioned in the spring receiving recess 126 embodied in this way.

A pin 131', which supports a hinge 131, is disposed in the displaceable end of the engagement bolt element 125. A knob follower 129 is positioned to be pivotably movable, at a distance opposite this pin 131' in the housing 123. The knob follower 129 has an end which tapers to a point, in which a hinge 132 is positioned. The hinges 131 and 132 are bridged by a hinge plate 133, as shown in FIG. 2, and form an end position hinge element 130 in this way. A follower pin 136 is positioned opposite the point on the knob follower 129. Furthermore, stop elements 134, 135 are positioned at both sides of the knob follower 129. Because of the connection of the knob follower 129 with the engagement bolt element 125, which can be tensioned by spring 124, by means of the end position hinge element 130, the engagement bolt element 125 takes up an engagement position in an extended state and a released position in the retracted state and thus defines end positions. The tip of the engagement bolt element 125 is provided with a bolt head 125'.

Figure 9:
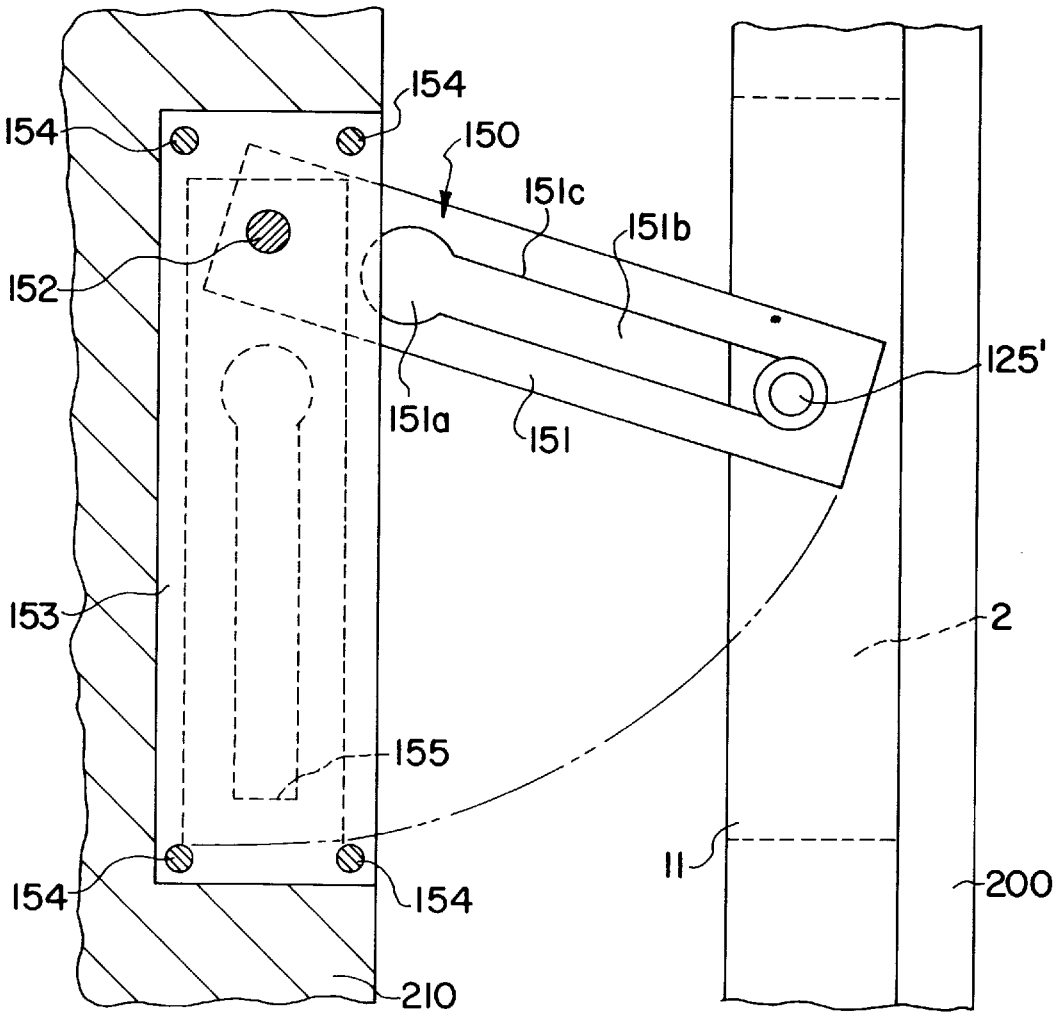
FIG. 9 is an elevational view of a pivot wing, taken along by an engagement bolt element, of a door catch mechanism in accordance with FIGS. 1, 2 and 8 with the door opened a crack.

In order for a door 200 to be brought in a position where it is opened a crack in respect to a door frame 210, as shown in FIG. 9, the bolt head 125' engages a connecting link 151. In the process a connecting link eye 151*a* of a pivot shackle 150 is penetrated. In the course of further pivoting of the door 200 in respect to the door frame 210, the bolt head 125' is guided to the end along a connecting link edge 151*c* inside a connecting link section 151*b* of a connecting link 151. The pivot shackle 150 is fastened in a pivotably movable manner by means of a hinge bolt 152 on an armature element 153, which is fastened by means of fastening elements 154 to the door frame 210.

Figure 6:
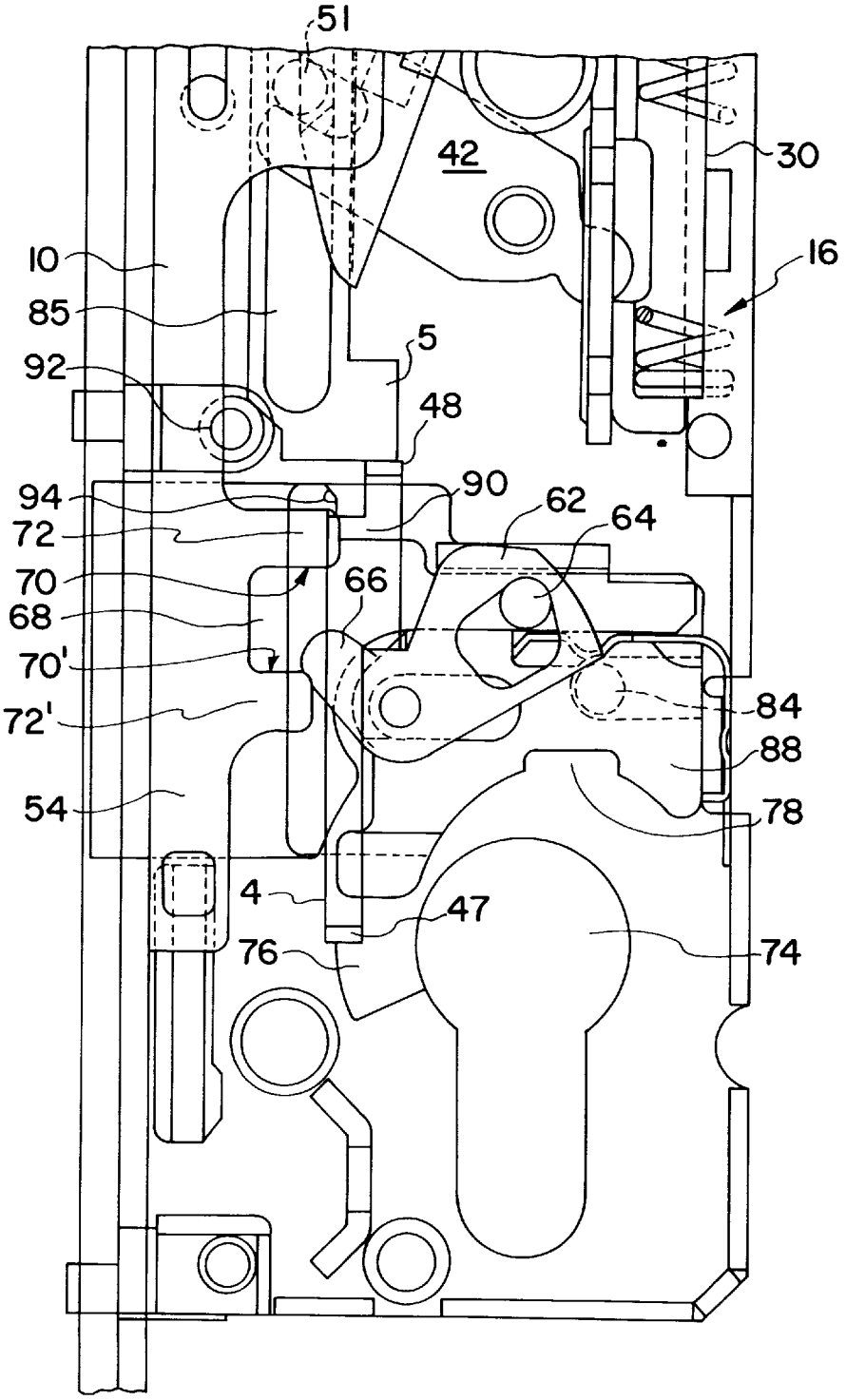
FIGS. 6 and 7 are further enlarged partial representations of a drive rod locking mechanism in accordance with FIG. 3.

The drive rod locking mechanism 1 is shown in detail in FIGS. 3, 6 and 7.

A lock housing 3 is fastened on a cuff plate 11 in the same way as the housing 123 of the door catch mechanism 2. The lock housing includes a bottom plate 3*a*, which is surrounded by narrow side enclosing walls 3*b*, 3*c* and 3*d* and is enclosed by a lock cover, not shown. A drive rod 10 is guided on the cuff plate 11, by means of which at least one additional lock can be actuated. Further than that, a latch 52 of a latch actuating mechanism 50 is disposed in the lock housing 3 which, when the door 200 is closed, is automatically pushed back against the force of a spring 53, can be retracted for opening the door 200 from the handle follower 12 with the aid of a cam 55 of the handle follower 12 of an engagement plate 57 and a catch tail 59.

Finally, the bar 54 is disposed in the housing 3 of the drive rod locking mechanism 1, which penetrates the cuff plate 11 and is brought into an extended position when the drive rod 10 is shifted into its locking position, i.e. downward.

Furthermore, the lock cylinder 74 and the lock bit 76 are used for blocking the drive rod 10 in its lower locking position and via the drive rod 10, are used for blocking the bar 54 in its extended position.

The drive rod 10 with the additional locks fastened thereon is shifted from the opening position into the locked position and vice versa exclusively by means of the outer or inner door handle (not represented), which is coupled with the handle follower 12.

The handle follower 12 cooperates with a bar/drive rod locking unit 9. To this end the handle follower 12 has an engagement pin 18, which enters into an edge recess 14 of a displaceable control element 16. A further recess 20 extending in the peripheral direction, which in a pivot range end position of the door handle rests against a stop pin 26 (159) arranged on the lock bottom plate 3*a*, is arranged for the limitation of the pivot angle of the door handle.

The control element 16 comprises a support plate in the form of a spring reception frame 30 (see FIG. 7), which is displaceably guided on the lock bottom plate 3*a*. Two pins 32, 32' are disposed between the lock bottom 3*a* and the lock cover (not shown) resting above it for guiding the control element 16. The spring reception frame 30 supports a helical compression spring 38. In the position of rest of the handle follower 12, the helical spring 38 rests with its ends on the respective pin 32, 32' as well as on the stop faces of the support plate or the spring reception frame 30, so that when the frame 30 is displaced downward, the helical compression spring 38 remains supported on the lower pin 32' and is compressed while being lifted off the upper pin 32, and vice versa.

On the side of the control element 16 facing the lock, an edge recess 40 for the engagement of the short lever arm of a transmission lever 42 is provided, which is pivotably seated on a bolt 44 fixed in place on the housing 3. The one end 46 of the transmission lever 42 is embodied to be approximately circular, while the other arm 49 forms a fork which extends around the pin 51 fixed in place on the drive rod 10.

In the position represented in FIG. 3, the drive rod 10 is in its topmost position, i.e. the opening position. When the handle follower 12 is pivoted by 45° in a counterclockwise direction, the control element 16 moves the lower end 46 toward the top, with the result that the drive rod 10 is simultaneously pushed downward in the direction toward its locking position since lever 42 pivots about the fixed bolt 44. If the handle is released in this state, and the handle follower 12 returns back to its original position, as represented in FIG. 3, under the effect of the helical compression spring 38, the circular end 46 of lever 42 rests free of play against the upper end face 40' of the recess 40, as shown in FIG. 7. A subsequent downward displacement of the control element 16 then leads immediately to a downward movement of the circular end 46 and thus also to a forward or upward movement of the drive rod 10 in the direction toward its open position.

With reference to FIGS. 3 and 6, an elbow lever 58 is pivotably seated on a bolt 56, fixed on the housing, for the disconnection of the bar 54, and extends over the bar tail 60. It comprises a fork-like embodied arm 62 of a bar pin 64 of the bar tail 60. The other arm 66 of this elbow lever 58 cooperates with a control profile of the drive rod 10. This control profile comprises a profile recess 68 and cams 72, 72' with facing profile faces 70, 70'. When the drive rod 10 moves downward, it initially moves freely with its recess 68 in respect to the arm 66 of the elbow lever 58 until the profile face 70 comes to rest against the arm 66. Extension of the bar 54 begins only at that time, wherein finally the arm 66 runs up on the plateau of the cam 72 which extends vertically in FIG. 3. After that no further displacement of the bar 54 takes place, even if the drive rod 10 continues to move further downward. In this way a drive rod stop bolt 92 can move behind a bar shoulder 94 or 54 during the remaining downward movement of the drive rod 10, so that a return movement of the bar 54 in the disconnected position of the bar 54 is suppressed by the drive rod stop bolt 92, which then is in its lowest position.

The mode of operation of the locking device as it results from the exemplary embodiment represented, will be described.

In the disconnected drive rod and bar position, the drive rod 10 and also the bar 54 can be secured by the actuation of the lock cylinder 74. After a one-turn rotation of the lock bit 76 in a counterclockwise direction, first a tumbler 78 is lifted and an additional bar 88 is released, so that upon continued rotation of the lock bit 76 it can then displace the additional bar 88 in the direction toward the right. The additional bar 88 extended to the left in this way then extends with a finger 90 behind the drive rod stop bolt 92 fixed on the drive rod 10, so that the drive rod 10 is blocked against unauthorized displacement out of the locked position upward into the open position. At the same time the key plate 4 is horizontally moved out of the turning range of the lock bit 76 by means of the tumbler 78. By means of this it is achieved that, with the door closed, the door catch mechanism 2 cannot be made ineffective. Furthermore, interference with the lock bit 76 during the unlocking process is prevented.

In the course of the actuation of the pin 51, fixed on the drive rod 10, with the aid of the transmission lever 42 pin 51 is displaced in the locking recess 85 in such a way that it can rest against its lower curved border.

If the lock bit 76 is moved in a clockwise direction, the additional bar 88 is moved back. By means of this it is possible to trigger the bar/drive rod locking unit 9 by actuating the handle follower 12 in such a way that the bar 54 and the drive rod are again moved back. It is simultaneously possible to actuate the latch actuating mechanism 50 with the aid of the handle follower 12 in such a way that the latch 52 can be pulled back. The lock plate 4 is simultaneously moved back under the latch plate 5 (original position).

If, as already described, the bolt element 125 has been displaced into an engagement position, the door can still not be opened because of its engagement with the pivot shackle 150.

If the closing movement is further performed in the clockwise direction, such as is customarily performed when opening a door, the lock bit 76 contacts the lower shaped leg 47 of the key plate 4. The key plate 4 is upwardly displaced by this and transmits the forward movement to the latch plate 5. During the forward movement of the latch plate 5, the guide spring 160 of the of the rod system stroke limitation element 7 is relieved (see FIG. 7). Simultaneously the guide lug 157 is led along the pivot bearing 159 (stop pin 26). In the process the tail of the rod system stroke limitation lever element 7 is moved in a direction toward pin 51, fixed on the drive rod 10, and grips it with the engagement recess 161. By means of this the entire rod system is brought into a resilient end position in the course of further forward movement.

In the course of the displacement movement of the latch plate 5, the movement transmission lever element 8 is moved. The stroke movement performed up to this point is converted into a pulling movement by the element 8 which leads to the door latch plate 6 moving downward.

In the course of downward movement (see FIGS. 2 and 8), the door catch plate 6 pulls on the end of the link stem 138 of the unlocking hammer 137. Because of this the unlocking lever 140 pivots out and pushes against the follower pin 136 of the knob follower 129. The knob follower 129 is moved in a clockwise direction by this, i.e. into an opening movement, and the end position hinge element 130 is triggered in such a way that it returns into its position of rest and the extended spring 124 can relax. The engagement bolt element 125 is pulled back by this into its release position in such a way that it pulls out of the connecting link eye 151*a* back to the level of the exterior limit surface of the cuff plate 11. The pivot shackle 150 remains in its position of rest and releases the door wing 200. Because of this it is assured by means of a customary opening process, which can be performed from the outside with the aid of a key, that the person who is authorized to open the door wing from the outside can unlock the drive rod locking mechanism 1 and the door catch mechanism 2.

What is claimed is:

1. A locking device for a door with a rigid frame, the locking device including:

a drive rod locking mechanism disposed in a door wing, the drive rod locking mechanism having a bar/drive rod locking unit which can be locked by means of a lock unit;

a door catch mechanism disposed separately from the drive rod locking mechanism, wherein, with a tensioning device which can take up two end positions, a bolt element disposed opposite an energy storage device can be pushed into an engagement and a release position in a catch unit hinged on a rigid door frame, and a rod system device extending from the lock unit to the tensioning device and connected with an unlocking hammer pivotably movably arranged in the door catch mechanism, the door catch mechanism having an unlocking lever which, in the engagement position of the bolt element, is positioned ready for contact opposite a trigger element of the tensioning device, so that, following unlocking of the bar/drive rod locking unit with the lock unit the bolt element can be moved from the engagement to the release position by a deflection of the unlocking hammer.

2. The locking device in accordance with claim 1, wherein the tensioning device includes a pivotably arranged knob follower on which the trigger element is disposed, and an end bar hinge element being pivotably movably disposed between an end of the knob follower opposite the trigger element and a pin on a bolt element.

3. The locking device in accordance with claim 1 or 2, wherein the rod system device is composed of:

a key plate which can be displaced by at least one of a lock bit of the locking unit and a tumbler of the bar/drive rod locking unit, a latch plate having a first end that can be laid against the key plate and a second end which is connected with an adjustable movement transmission element, the key plate and the latch plate being arranged together in the drive rod locking mechanism, and a door catch plate which bridges a gap between the drive rod locking mechanism and the door catch mechanism, and into a first end of which the movement transmission element projects in a frictionally connected manner and into a second end of which the unlocking hammer projects in a frictionally connected manner.

4. The locking device in accordance with claim 1, wherein the key plate has a U-shaped profile guided parallel with the bar, the key plate having a first U-shaped leg which can be contacted by the lock bit and a second U-shaped leg which rests against the latch plate.

5. The locking device in accordance with claim 1, wherein the latch plate has a locking recess, a pin fixed on drive rod of the bar/drive rod locking unit being displaceably disposed in the locking recess.

6. The locking device in accordance with claim 3, wherein:

the movement transmission element is a profiled element having an L-shape, a first L-shaped leg which is a lever rod element which projects into a rod engagement recess, and a second L-shaped leg shorter than the first L-shaped leg which is a contact lever element connected in a rotatingly movable manner with the other end of the latch plate, and a rotating lever bearing is disposed at a connecting point of the movement transmission element between the rod lever element and the contact lever element.

7. The locking device in accordance with claim 3, wherein the unlocking hammer includes a link stem one end of which is frictionally connected with the door catch plate, and whose other end is seated with a hammer in a pivot point.

8. The locking device in accordance with claim 7, wherein the hammer is composed of the unlocking lever and a stop lever disposed opposite the pivot pin.

9. The locking device in accordance with claim 7, wherein an energy storage-guided rod system stroke limitation element is disposed on the latch plate, the latch plate having an engagement recess which can be positioned opposite the pin fixed in place on the drive rod.

* * * * *